United States Patent [19]

Johnson

[11] 4,266,378

[45] May 12, 1981

[54] GLASS ETCHING DEVICE

[76] Inventor: J. Peter Johnson, 4002 E. 75th St., Indianapolis, Ind. 46250

[21] Appl. No.: 41,010

[22] Filed: May 21, 1979

[51] Int. Cl.[3] ..... B24C 1/04; B24C 3/32

[52] U.S. Cl. ..... 51/432; 51/262 R; 51/310

[58] Field of Search ..... 51/262 R, 310, 412, 51/432, 433, 434, 435; 118/504

[56] References Cited

U.S. PATENT DOCUMENTS

| | | | |
|---|---|---|---|
| 2,001,886 | 5/1935 | Rabezzana | 51/412 |
| 2,299,405 | 10/1942 | Prange | 51/310 X |
| 3,160,990 | 12/1964 | Bowling | 51/432 X |
| 3,267,621 | 8/1966 | Meyers | 51/312 |
| 3,520,086 | 7/1970 | Stevens | 51/310 X |
| 3,675,373 | 7/1972 | Putnam | 51/424 |
| 3,694,963 | 10/1972 | Leliaert | 51/434 |
| 3,702,496 | 11/1972 | Stevens | 51/262 R |
| 3,704,552 | 12/1972 | Beaver | 51/412 |
| 3,868,790 | 3/1975 | Fricke | 51/412 |
| 4,028,851 | 6/1977 | Fricke | 51/412 |
| 4,062,155 | 12/1977 | Fricke | 51/412 |
| 4,109,507 | 8/1978 | Neidigh | 51/432 X |

FOREIGN PATENT DOCUMENTS

| | | | |
|---|---|---|---|
| 2538228 | 3/1977 | Fed. Rep. of Germany | 51/432 |
| 559084 | 2/1975 | Switzerland | 51/435 |

*Primary Examiner*—Gary L. Smith

[57] ABSTRACT

A device for etching glass. An electric motor rotates an impellor enclosed within a housing into which abrasive particulate material is drawn by means of an inclined tube. The impellor, impellor housing and inclined tube are located within a compartment partially filled with abrasive particulate material. The blades of the impellor are arranged to provide a pulsating pressure. A flexible grommet defines a passage aligned with the housing outlet with the grommet conformingly and sealingly engaging the surface to be etched.

7 Claims, 8 Drawing Figures

GLASS ETCHING DEVICE

BACKGROUND OF THE INVENTION

This invention is in the field of etching and more particularly those devices which are used to etch glass with abrasive particulate material. A variety of devices have been used to etch glass. For example, vibratory devices have been used to etch letters and other symbols into a variety of surfaces including metal surfaces as well as glass. Vibratory etching techniques typically require each etched symbol to be manually traced. On the other hand, it is possible to etch an entire symbol upon a surface by using a mask outlining the symbol and by then blasting abrasive particulate material against the surface. Relatively large compressors are required to force the abrasive particulate material with sufficient force to cause the desired result. In the U.S. Pat. No. 3,267,621 issued to W. F. Meyers et al., a single grit blast nozzle is disclosed along with a resist mask screened on the tumbler to be etched with a particular design.

The grit blast technique of etching a glass tumbler is particularly disadvantageous in that the compressor must be large to force the grit with sufficient speed against the tumbler. As a result, the glass will frequently break, especially in thin-walled vessels as a result of the grit impinging the thin wall with great force. In addition, the large compressors not only consume a large amount of electrical current, but in addition frequently break down necessitating expensive repairs. There is a particular need for a device for etching designs, such as a person's initials, in a variety of thin-walled glass vessels. Disclosed herein is such a device which is sufficiently small to be easily carried into a shopping center mall wherein the etching service business may be accomplished on a relatively temporary or movable basis. The device disclosed herein uses an impellor to throw the grit against the surface being etched in lieu of blasting the grit and as a result, the device may be operated by conventionally available sources of electrical energy without requiring a large amount of electrical current for operation. The device further enables etching of the thin-walled glass vessels, such as wine glasses, without any danger of breakage from the etching process.

It is known to etch by means of throwing the grit in lieu of the traditional blast method. For example, U.S. Pat. No. 3,675,373 issued to David T. Putnam discloses a wheel which discharges by centrifugal force abrasive particles. Further, it is known that spark plugs may be cleaned with grit-throwing devices such as are disclosed in the U.S. Pat. Nos. 3,704,552 issued to Bud K. Beaver et al. and 3,868,790; 4,028,851; and 4,062,155 all issued to Roy A. Fricke.

Another need not satisfied by the heretofore known devices is the ability to etch vessels having a variety of different-sized radial surfaces without necessitating a special adaptor to conform to the surface being etched. The device disclosed herein will etch a symbol on surfaces of a wide radial range without requiring a special mask adaptor.

SUMMARY OF THE INVENTION

One embodiment of the present invention is an etching device comprising a frame with a closed abrasive particulate storage compartment, the frame including an outlet through which abrasive particulate from the compartment passes, an electric motor mounted on the frame and having a rotatable output shaft, an impellor removably mounted to the frame and having a plurality of radially extending blades located in the compartment and positioned to throw abrasive particulate from the compartment through the outlet, a flexible grommet mounted to the frame defining a passage in line with the outlet, the grommet having a radially depressible outer surface to conformingly and sealingly engage a curved surface to be etched, and a plurality of masks, each having a differently configured opening extending therethrough defining a symbol to be etched, each mask seatable against the grommet with the opening aligned with the passage to allow abrasive particulate to pass.

It is an object of the present invention to provide a new and improved etching device.

A further object of the present invention is to provide a device for etching a thin-walled glass surface.

In addition, it is an object of the present invention to provide a glass etching device which is operable to etch a variety of radial surfaces without requiring special adaptors to conform to each different radial surface.

Related objects and advantages of the present invention will be apparent from the following description.

DESCRIPTION OF THE PREFERRED EMBODIMENT

Figure 1:
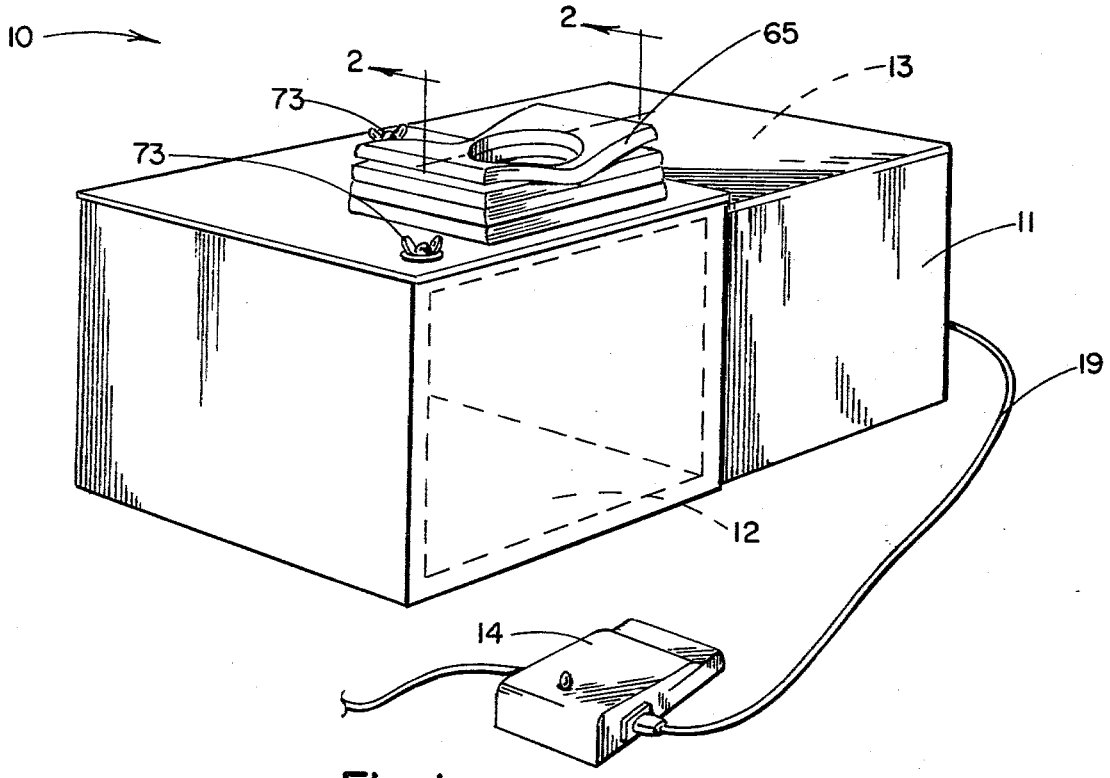
FIG. 1 is a perspective view of the etching device incorporating the subject invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
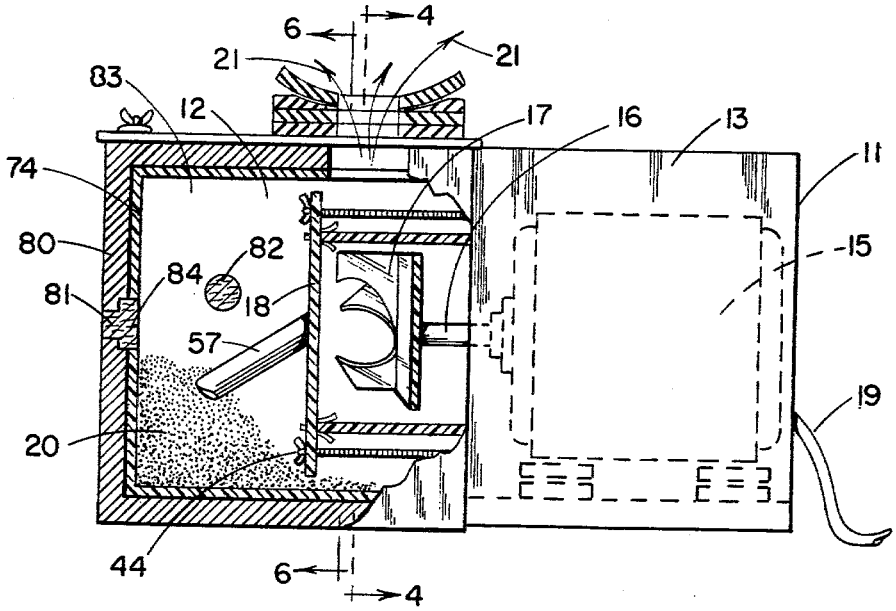
FIG. 3 is a fragmentary side view of the device of FIG. 1 showing the compartment containing abrasive particulate along with the impellor.

Referring now more particularly to FIG. 1, there is shown a device 10 for etching a variety of surfaces including thin-walled glass surfaces. Device 10 includes a main frame 11 having a first compartment 12 and a second compartment 13 in which is mounted a conventional electric motor 15 (FIG. 3).

Electric motor 15 is connected to a source of electrical energy by cord 19 which is routed through a footoperated pedal 14 for controlling the flow of electrical energy to motor 15. The motor has a rotatably driven output shaft 16 upon which is removably mounted an impellor 17 enclosed within housing 18. Compartments 12 and 13 are separated with drive shaft 16 extending into compartment 12. A supply of abrasive particulate material 20 is located within compartment 12 and is drawn up to the impellor and thrown outwardly in the direction of arrows 21 to etch the surface under consideration.

Figure 5:
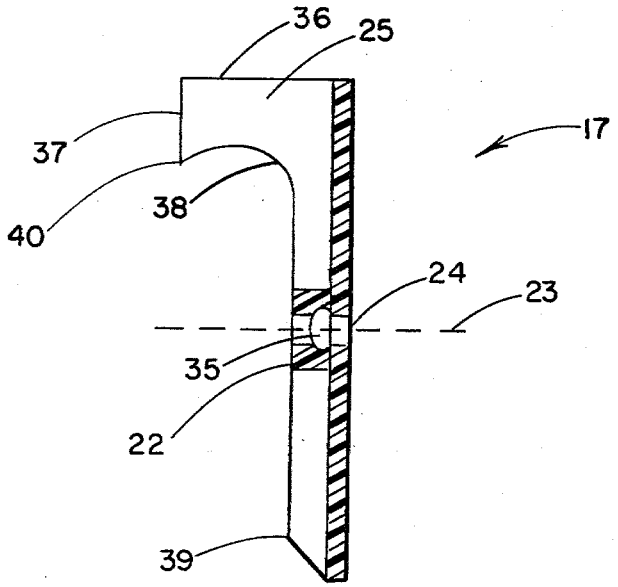
FIG. 5 is a cross-sectional view of the impellor taken along line 5—5 of FIG. 4 and viewed in the direction of the arrows.
Figure 4:
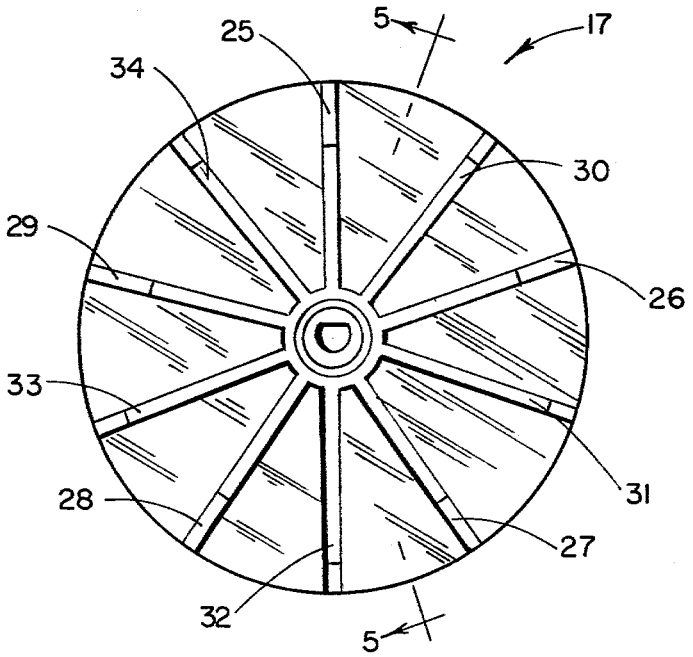
FIG. 4 is an enlarged end view of the impellor looking in the direction of arrows 4—4 of FIG. 3.

Impellor 17 (FIGS. 4 and 5) has a disc-shaped main body upon which a plurality of blades are mounted extending radially outward from the hub 22 of the impellor which surrounds the axis of rotation 23. A hole 24 extends through hub 22 to receive the drive shaft 16 of the electric motor. Groove 35 is provided within hole 24 to releasably engage a ridge or other suitable projection provided on the drive shaft and to allow the impellor to be snapped onto and off of the drive shaft for maintenance purposes.

The impellor blades are arranged in a first set of blades including blades 25–29 and a second set of blades 30–34. Blade 25 will now be described, it being understood that a similar description applies to blades 26–29. Blade 25 extends radially outward from hub 22 to the periphery of the main body of the impellor. Blade 25 extends a greater axial distance at the periphery of the impellor as compared to the center portion of the impellor defined by hub 22. The outer edge 36 of blade 25 is parallel to axis 23 and is perpendicularly arranged to edge 37 which extends back toward axis 23 terminating into a sloping edge 38 which gradually decreases the axial length of the blade. Blades 30–34 likewise extend radially outward from hub 22; however, blades 30–34 have a constant axial length from hub 22 to immediately adjacent the periphery of the impellor whereat the axial length of the blades decrease. Thus, the first set of blades composed of blades 25–29 extend a greater axial distance at the periphery of the impellor than the second set of blades composed of blades 30–34. The first set of blades 25–29 throw the abrasive material outwardly due to their increased axial length. It will be noted that the first set of blades are arranged in alternate fashion with the second set of blades around the axis of rotation of the impellor. As a result, a pulsating pressure is supplied by the impellor resulting in a superior flow of abrasive particulate through the outlet of the compartment to the surface being etched. It has been found that excellent results are obtained by decreasing the axial length of the second set of blades 30–34 at a location 39 which corresponds approximately to the radial distance of location 40 from axis 23 located between edges 37 and 38 of the first set of blades.

Figure 6:
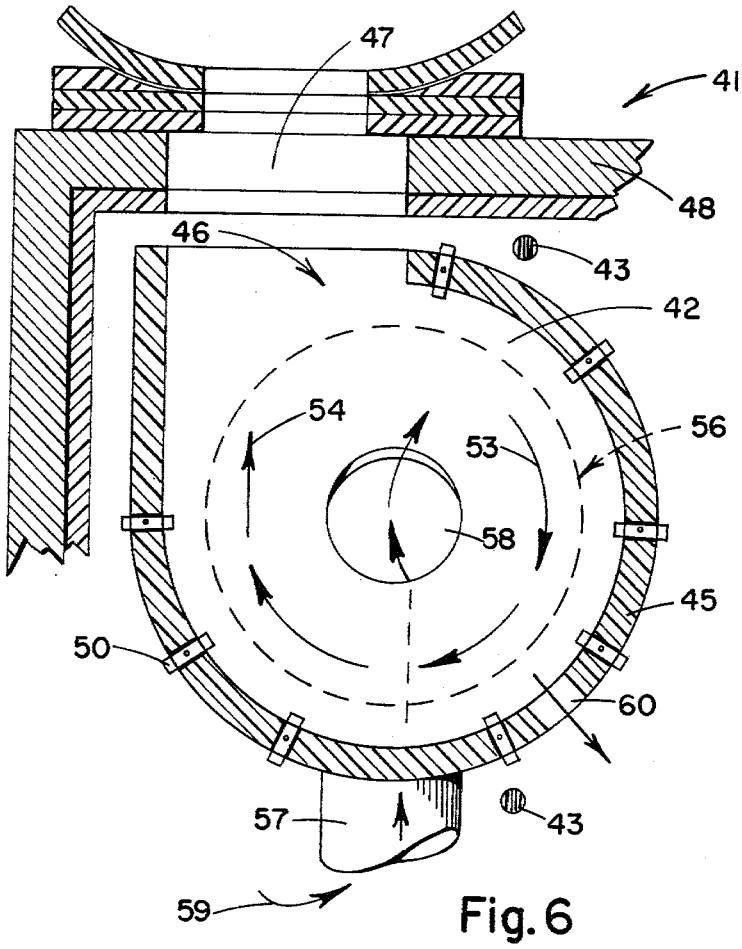
FIG. 6 is an enlarged cross-sectional view of the impellor housing and a portion of the frame of the device taken along line 6—6 of FIG. 3 and viewed in the direction of the arrows.
Figure 7:
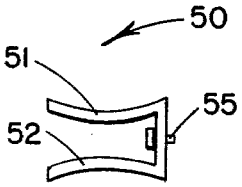
FIG. 7 is an enlarged view of one of the clips for mounting the removable curved impellor housing wall.

Impellor housing 41 (FIG. 6) extends around the impellor to direct the abrasive particulate material as well as create a low-pressure region at the axis of rotation of the impellor to thereby pull the abrasive particulate material upwardly to the center of the impellor which then throws the abrasive particulate outwardly. Housing 41 includes a flat plate 42 mounted to frame 11 by a plurality of conventional screws 43 having their proximal ends attached to frame 11 with the screws then extending through plate 42 which is secured to the screws by a plurality of conventional wing nuts 44 (FIG. 3). Plate 42 is mounted to frame 11 to be positioned axially adjacent but spaced slightly from the impellor with the impellor located between plate 42 and the electric motor. A disposable curved wall 45 is removably mounted to plate 42 and extends peripherally around the impellor to define an abrasive particulate escape hole 46 located adjacent the impellor and immediately beneath outlet 47 of the top wall 48 removably mounted to the frame. A plurality of clips 50 are mounted to wall 42 with each clip having a pair of spring-biased legs 51 and 52 for releasably engaging wall 45. Thus, as the abrasive particulate matter is thrown against wall 45 in a clockwise direction, shown by arrow 53, and out through hole 46 in the direction of arrow 54, the abrasive particulate or grit will impinge the inside surface of wall 45 eventually requiring removal of the wall and reinsertion of a new wall identical to wall 45. Clips 50 therefore provide a means mounted to plate 42 providing a removable mount for wall 45. Clips 50 may be mounted to plate 42 by conventional fastening means such as rivets 55. The periphery of the impellor is shown by dashed line 56 being located inwardly of screws 43 and clips 50.

An upwardly inclined tube 57 is cantileveredly mounted to plate 42 and defines a passageway through which the grit may pass from the floor of compartment 12 to the center portion of the impellor. Plate 42 is provided with an aperture 58 in communication with the passageway formed by tube 57 with aperture 58 being located immediately across from the hub of the impellor. A low-pressure region formed at the center portion of the impellor due to the impellor rotation therefore causes the grit to be drawn upwardly in the direction of arrows 59 through tube 57 and into the impellor housing. The impellor blades then throw the grit outwardly from the impellor housing in the direction of arrow 54.

A small aperture 60 is provided at the bottom of housing 41 in wall 45 to allow any grit which accumulates in the housing to escape. Frequently, the grit may build up within the housing once the electric motor is turned off. However, it is to be understood that the main portion of the grit is thrown outwardly through hole 46.

Figure 2:
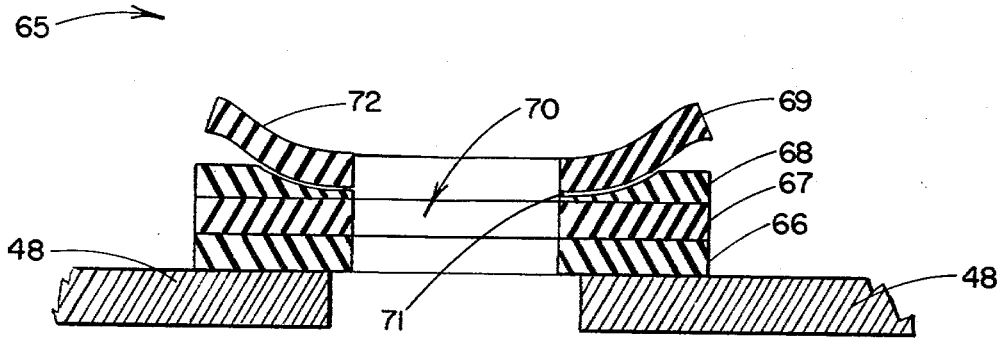
FIG. 2 is an enlarged fragmentary cross-sectional view taken along line 2—2 of FIG. 1 and viewed in the direction of the arrows.

A flexible grommet 65 is mounted to frame 11 defining a passage through which the abrasive material may pass to the surface being etched. Grommet 65 (FIG. 2) includes a stack of layers of flexible sheets. For example, the grommet shown in FIG. 2 has four separate flexible sheets 66 through 69 with passage 70 extending therethrough. The second outermost sheet 68 has a beveled interior edge portion 71 extending around passage 70. The outermost sheet 69 has an outwardly facing curved surface 72 which is formed as a result of the outermost sheet 69 being in contact with the beveled interior edge portion 71. The sheets may be secured together by any type of suitable adhesive material and in turn are secured to the top wall 48. Top wall 48 is removably mounted to frame 11 by a plurality of upwardly extending threaded members 73 and conventional wing nuts. Wall 48 is removed whenever the supply is grit is to be refurbished or in the event that a component such as the impellor 17 or curved side wall 48 is to be replaced with a new impellor or side wall. Best results have been obtained by producing the impellor and curved wall 45 from a plastic material. Further, compartment 12 is provided with a plastic liner 74 extending completely around the compartment. The liner is configured as a box and is positioned within the compartment to hold the abrasive particulate while protecting the side walls of frame 11.

Compartment 12 is closed except for hole 47 (FIG. 6) and a pair of breathing holes provided in the end wall and side wall of the frame. For example, end wall 80 of the frame (FIG. 3) is provided with an air hole 81 filled by a suitable material 84, such as felt, allowing air to enter into the compartment but preventing the grit from escaping the compartment through hole 81. Likewise, a similar breathing hole 82 is provided in side wall 83 being filled with a material such as felt 84.

Figure 8:
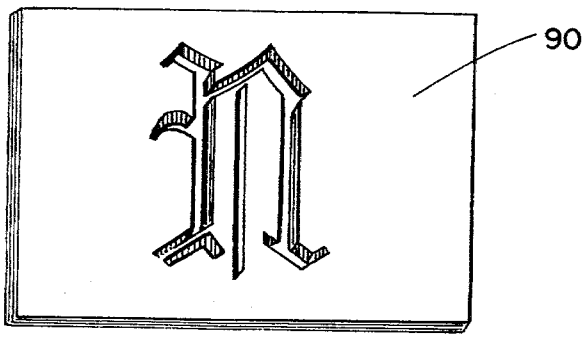
FIG. 8 is a perspective view of one of the masks for use with the device shown in FIG. 1.

A plurality of rubber masks are provided, each having a differently configured opening extending through the mask to define the particular symbol to be etched. For example, mask 90 (FIG. 8) is provided with an aperture forming the letter "N". The particular mask such as mask 90 is placed atop the outermost sheet 69 of the flexible grommet to align the mask opening with passage 70 which in turn is aligned with hole 47 of wall 48 and opening 46 of the impellor housing thereby allowing the grit to be thrown through the mask against the surface to be etched. Due to the multiple layers of flexible materials present in grommet 65 as well as beveled edge 71, the grommet will sealingly conform to the particular curved surface to be etched and will accept a variety of different radially curved surfaces thereby eliminating the need for a special sealing adaptor to be placed between the grommet and surface to be etched.

A variety of different types of abrasive particulate material may be used with the present invention including sand and silicon carbide. Depending upon the depth of etch desired, the glass surface may be etched in a matter of seconds. It can be appreciated that the etching device disclosed herein may be used to etch surfaces in addition to glass, such as metal surfaces.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. An etching device comprising:

a frame with a closed abrasive particulate storage compartment, said frame including an outlet through which abrasive particulate from said compartment may pass;

an electric motor mounted on said frame and having a rotatable output shaft;

an impellor removably mounted to said frame and having a plurality of radially extending blades located in said compartment and positioned to throw abrasive particulate from said compartment through said outlet;

a flexible grommet mounted to said frame defining a passage in line with said outlet, said grommet having a radially depressible outer surface to conformingly and sealingly engage a curved surface to be etched;

a plurality of masks, each having a differently configured opening extending therethrough defining a symbol to be etched, each mask seatable against said grommet with said opening aligned with said passage to allow abrasive particulate to pass;

said blades are arranged in a first set of blades and a second set of blades, said first set of blades extend a greater axial distance at the periphery of said impellor than said second set of blades with said first set of blades arranged in alternate fashion with said second set of blades around the axis of rotation of said impellor to produce a pulsating pressure with the abrasive particulate;

said impellor has a center portion and a certain location located radially outwardly therefrom, said blades of said second set extend an equal axial distance from the center portion of said impellor to said certain location whereat said blades in said second set decrease in axial length;

a plate mounted to said frame and positioned axially adjacent said impellor with said impellor located between said plate and said motor;

a disposable curved wall removably mounted to said plate and extending peripherally around said impellor and defining a hole located adjacent said impellor and said outlet;

means engaged with said plate and said curved wall operable to removably mount said curved wall;

a removable plastic liner positioned within said compartment to hold abrasive particulate located within said compartment, and wherein said grommet includes a stack of flexible sheets with said passage extending centrally therethrough, one of said sheets has a beveled interior edge extending around said passage, said stack has an outermost flexible sheet with an outwardly facing curved surface formed by said outermost flexible sheet being in contact with said beveled interior edge.

2. An apparatus for etching a curved outer surface of fixed contour of a container comprising:

an etching device including a frame with a closed abrasive particulate storage compartment with said frame having an outlet through which abrasive particulate from said compartment may pass;

first means mounted to said frame and located in said compartment being positioned to force abrasive particulate from said compartment through said outlet;

power means associated with said first means operable to power said first means;

a flexible grommet mounted to said frame defining a passage in line with said outlet, said grommet having a radially depressible outer surface assuming said fixed contour and conformingly and sealingly engaging said curved surface, said outer surface limiting the location of said container which is in a position other than in said passage to allow unobstructed movement of said abrasive particulate within said passage; and a plurality of masks, each having a differently configured opening extending therethrough defining a symbol to be etched, each mask positionable between and against said grommet and curved surface with said opening aligned with said passage to allow abrasive particulate to pass.

3. The apparatus of claim 2 wherein said outer surface of said flexible grommet is performed as a curved surface.

4. The apparatus of claim 2 wherein said grommet includes a stack of flexible sheets with said passage extending centrally therethrough, said stack has an outermost flexible sheet with an outwardly facing curved surface.

5. The apparatus of claim 2 wherein said grommet includes a stack of flexible sheets with said passage extending centrally therethrough, one of said sheets has a beveled interior edge extending around said passage, said stack has an outermost flexible sheet with an outwardly facing curved surface formed by said outermost flexible sheet being in contact with said beveled interior edge.

6. An ethcing device comprising:

a frame with a closed abrasive particulate storage compartment, said frame including an outlet through which abrasive particulate from said compartment may pass;

first means mounted to said frame and located in said compartment being positioned to force abrasive particulate from said compartment through sad outlet;

power means associated with said first means and operable to power said first means;

a flexible grommet mounted to said frame defining a passage in line with said outlet, said grommet having a radially depressible outer surface to conformingly and sealingly engage a curved surface to be etched; and a plurality of masks, each having a differently configured opening extending therethrough defining a symbol to be etched, each mask seatable against said grommet with said opening aligned with said passage to allow abrasive particulate to pass and wherein said grommet includes a stack of flexible sheets with said passage extending centrally therethrough.

7. The etching device of claim 6 wherein one of said sheets has a beveled interior edge extending around said passage, said stack has an outermost flexible sheet with an outwardly facing curved surface formed by said outermost flexible sheet being in contact with said beveled interior edge.

* * * * *

UNITED STATES PATENT AND TRADEMARK OFFICE

CERTIFICATE OF CORRECTION

PATENT NO. : 4,266,378

DATED : May 12, 1981

INVENTOR(S) : J. Peter Johnson

It is certified that error appears in the above-identified patent and that said Letters Patent are hereby corrected as shown below:

In column 6, line 58, "performed" should be --preformed--

In column 7, line 12, "sad" should be --said--

Signed and Sealed this

*Twenty-first* Day of *July 1981*

[SEAL]

*Attest:*

GERALD J. MOSSINGHOFF

*Attesting Officer*

*Commissioner of Patents and Trademarks*